United States Patent [19]

Uhtenwoldt et al.

[11] 4,096,667

[45] Jun. 27, 1978

[54] INTERNAL GRINDING MACHINE

[75] Inventors: Herbert R. Uhtenwoldt; Norman S. Humes, both of Worcester; Richard E. Crossman, Leominster, all of Mass.

[73] Assignee: Cincinnati Milacron-Heald Corp., Worcester, Mass.

[21] Appl. No.: 825,431

[22] Filed: Aug. 17, 1977

Related U.S. Application Data

[63] Continuation of Ser. No. 676,041, Apr. 12, 1976, abandoned.

[51] Int. Cl.[2] ..... B24B 5/10

[52] U.S. Cl. ..... 51/99; 51/105 R; 51/165.87; 51/165.93

[58] Field of Search ..... 51/47, 97 R, 97 NC, 51/105 R, 166 FB, 99, 165.87, 165.89, 165.93

[56] References Cited

U.S. PATENT DOCUMENTS

| | | | |
|---|---|---|---|
| 2,619,135 | 11/1952 | Callaway | 51/166 FB |
| 3,919,810 | 11/1975 | Voumard | 51/165.93 X |
| 3,958,370 | 5/1976 | Edgar | 51/165.89 |
| 3,972,148 | 8/1976 | Beauchet | 51/105 R X |

*Primary Examiner*—N. P. Godici

*Attorney, Agent, or Firm*—Norman S. Blodgett; Gerry A. Blodgett

[57] ABSTRACT

Internal grinding machine having wheelhead mounted on an elongated cylindrical bar whose axis extends parallel to but substantially spaced from the axis of the abrasive wheel, the bar being mounted in bearings and the relative movements of the wheelhead for producing a grinding cycle being accomplished by rotation of the bar about its axis and by longitudinal motion of the bar along its axis.

9 Claims, 9 Drawing Figures

FIG. 5
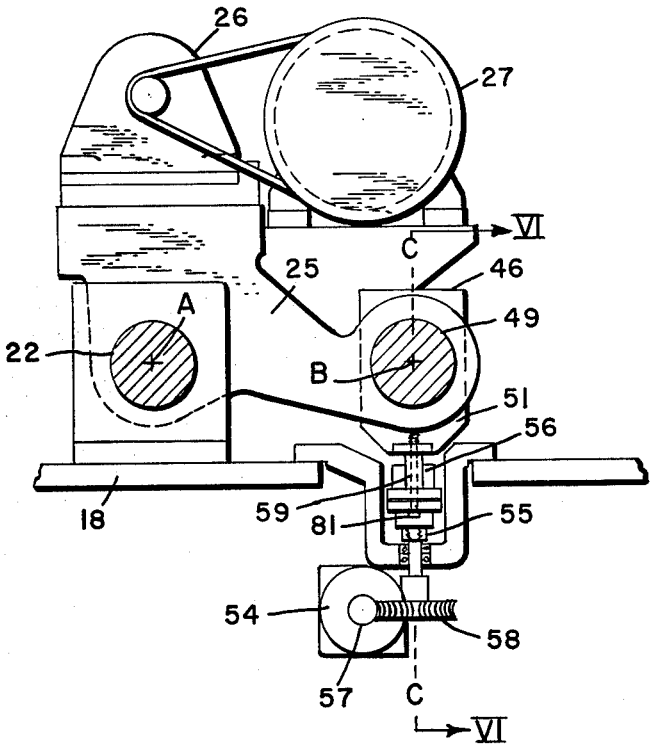
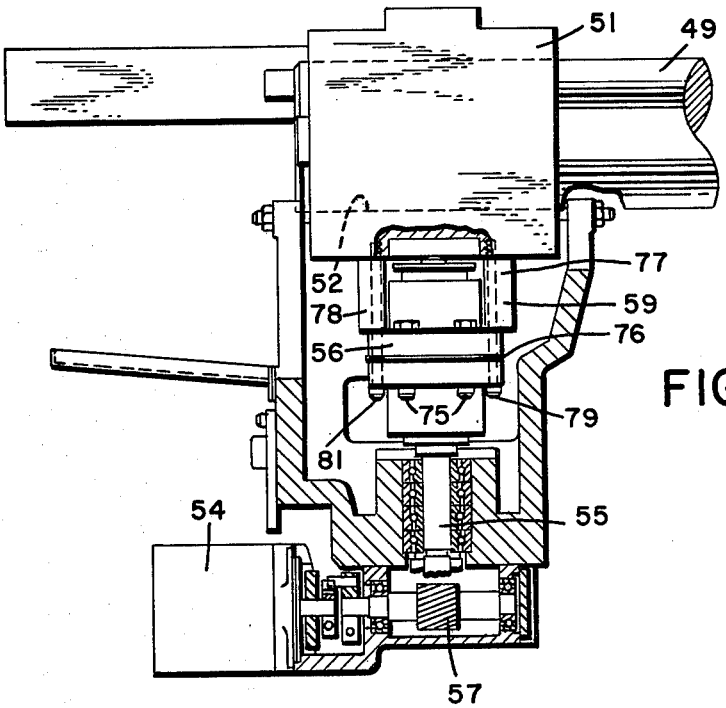
FIG. 6

INTERNAL GRINDING MACHINE

This is a continuation of application Ser. No. 676,041, filed Apr. 12, 1976, now abandoned.

BACKGROUND OF THE INVENTION

In the design of machine tools, it has been suggested that it would be advantageous to mount the tool on an arm extending radially from a large rigid cylindrical bar which, in turn, is rigidly mounted in bearings; such a construction is shown used in a boring machine in the patent of Jacobson U.S. Pat. No. 3,635,109, and used in a grinding machine in the patent of Hahn No. 3,601,931. One of the advantages of this construction is that it is possible to do away with expensive, plane surface-type guides or ways. Such ways are difficult to generate accurately in the first place and are difficult to locate in the second place. It is elementary knowledge that a cylindrical surface is easier to machine accurately than are plane surface elements. The stress problems which lead to inaccuracy in a machine tool are also obviated by the use of the large rigid bar as the principle moving element. When one attempts to apply this principle to the construction of horizontal internal grinding machines, however, a number of problems are presented. This is because the internal grinding process is greatly complicated by the fact that the spindle on which the abrasive wheel is mounted is a relatively thin cantilever beam and is, therefore, more easily deflected than a beam which has more than one support. Another limitation inherent to the internal grinding process resides in the fact that the wheel can be no larger than the bore to be ground and, usually, must be substantially smaller. This means that a compromise always exists between the stock available in the abrasive wheel between new wheel and worn wheel sizes, on the one hand, and the diameter of the spindle on which it is mounted, on the other hand. The available radial abrasive stock in the wheel determines the length of time between wheel changes and, since wheel change time is non-productive, it is important that this available stock be as great as possible. On the other hand, the larger radial wheel stock means a smaller diameter spindle which means that the spindle bends more easily and this introduces inaccuracies into the grinding operation. While the longitudinal movements of the abrasive wheel in and out of the bore present no particular problems, the crossfeed motion of a modern internal grinding machine is very complex. Various movements of the wheel must take place in approaching the work surface in rough grinding, in locating for a dress traverse, in compensating for dress, in performing a finish grinding operation, and in providing a spark-out operation; the values of all of these matters are possibly changed as the wheel wears from a large new wheel to a small worn wheel. In addition, it is desirable to provide a special cycle for the dressing of a new wheel before the grinding of the first piece begins. When these feeding operations are provided, in the manner set forth above, by rotating a bar on which the wheelhead is mounted, the problem of maintaining accuracy cannot be solved by conventional means. These and other difficulties experienced with the prior art devices have been obviated in a novel manner by the present invention.

It is, therefore, an outstanding object of the invention to provide an internal grinding machine with a simple and rugged construction which is capable of a high degree of accuracy and highly repetitive incremental motions.

Another object of this invention is the provision of an internal grinding machine in which the grinding stresses are restricted to a few elements involved in the actual grinding operation and in which the remainder of the machine can be made of a relatively light, inexpensive construction.

It is another object of the instant invention to provide an internal grinding machine in which only a small portion of the grinding stresses are transmitted to the main guide surfaces.

It is another object of the instant invention to provide an internal grinding machine having a low vertical profile and in which the horizontal dimensions are reduced, thus providing a machine of relatively small volume as compared with conventional grinding machines of like capacity, among other advantages.

A still further object of the invention is the provision of an internal grinding machine in which substantially all crossfeed motions take place under digital control without the inaccuracies introduced by analog control.

It is a further object of the invention to provide an internal grinding machine which is simple in construction, which can be inexpensively manufactured, and which is capable of a long life of useful service with a minimum of maintenance.

It is a further object of the invention to provide an internal grinding machine making use of a cylindrical bar as the major guide element in which the bearing surface spread is maximized without increasing the overall size of the machine.

It is a still further object of the present invention to provide an internal grinding machine making use of two cylindrical bars as the principle guide elements and in which inaccuracies introduced by deflection of the bars is minimized.

With these and other objects in view, as will be apparent to those skilled in the art, the invention resides in the combination of parts set forth in the specification and covered by the claims appended hereto.

SUMMARY OF THE INVENTION

In general, the invention consists of an internal grinding machine with a base from which extend two spaced abutments. A primary bar extends between the abutments and is mounted in bearings carried in the abutments for rotation about an axis extending longitudinally of the bar. A table with a wheelhead and rotatable spindle with an abrasive wheel is fastened to the bar between the abutments and extending laterally thereof. A feed means is provided extending between the base and the table and acting at a position substantially spaced from the said axis, the feed means serving to rotate the table and the bar together.

More specifically, a secondary bar is mounted on the table with its axis extending parallel to and spaced from the axis of the primary bar. The feed means includes a block containing a bearing through which the secondary bar is slidable. The feed means includes a stepping motor driving a ball screw operating along a line perpendicular to a plane passing through both of the said axes. The rotation of the primary bar and the workhead causes the abrasive wheel to move through an arc during a portion of which the wheel is removing stock from the workpiece at the said surface of revolution.

BRIEF DESCRIPTION OF THE DRAWINGS

The character of the invention, however, may be best understood by reference to one of its structural forms, as illustrated by the accompanying drawings, in which:

FIG. 5 is a vertical sectional view of the invention taken on the line V—V, FIG. 6 is a vertical sectional view of the feed mechanism taken on the line VI—VI of FIG. 5.

DESCRIPTION OF THE PREFERRED EMBODIMENT

Figure 1:
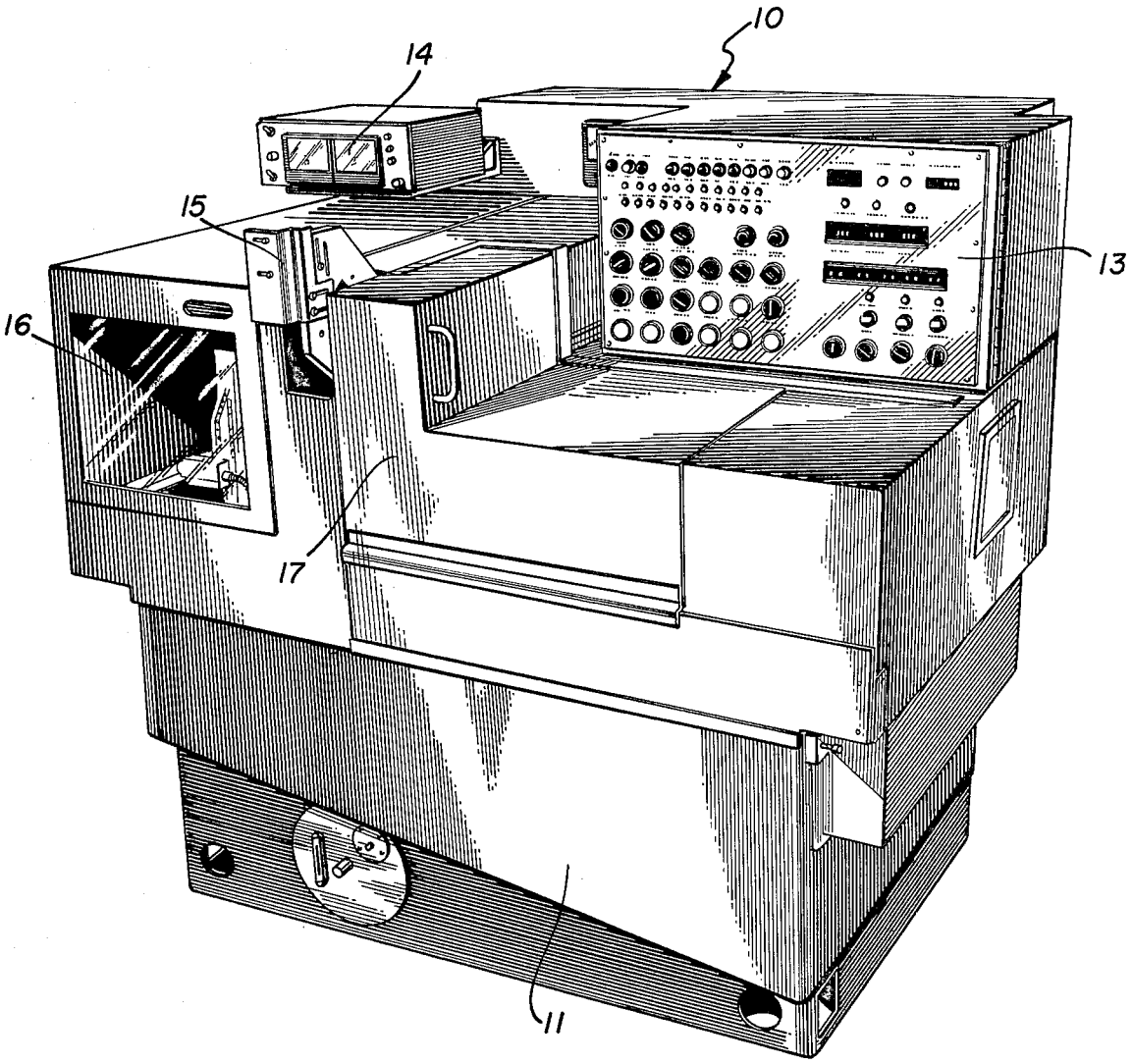
FIG. 1 is a perspective view of a grinding machine incorporating the principles of the present invention.

Referring first to FIG. 1, wherein are best shown the general features of the invention, the grinding machine, indicated generally by the reference numeral 10, is shown as being of the internal grinding type and as having a housing 11. At the top of the housing is located a main control 13 and a size control 14. The loading mechanism 15 protrudes from the upper part of the housing and covers 16 and 17 cover the operating elements of the machine.

Figure 2:
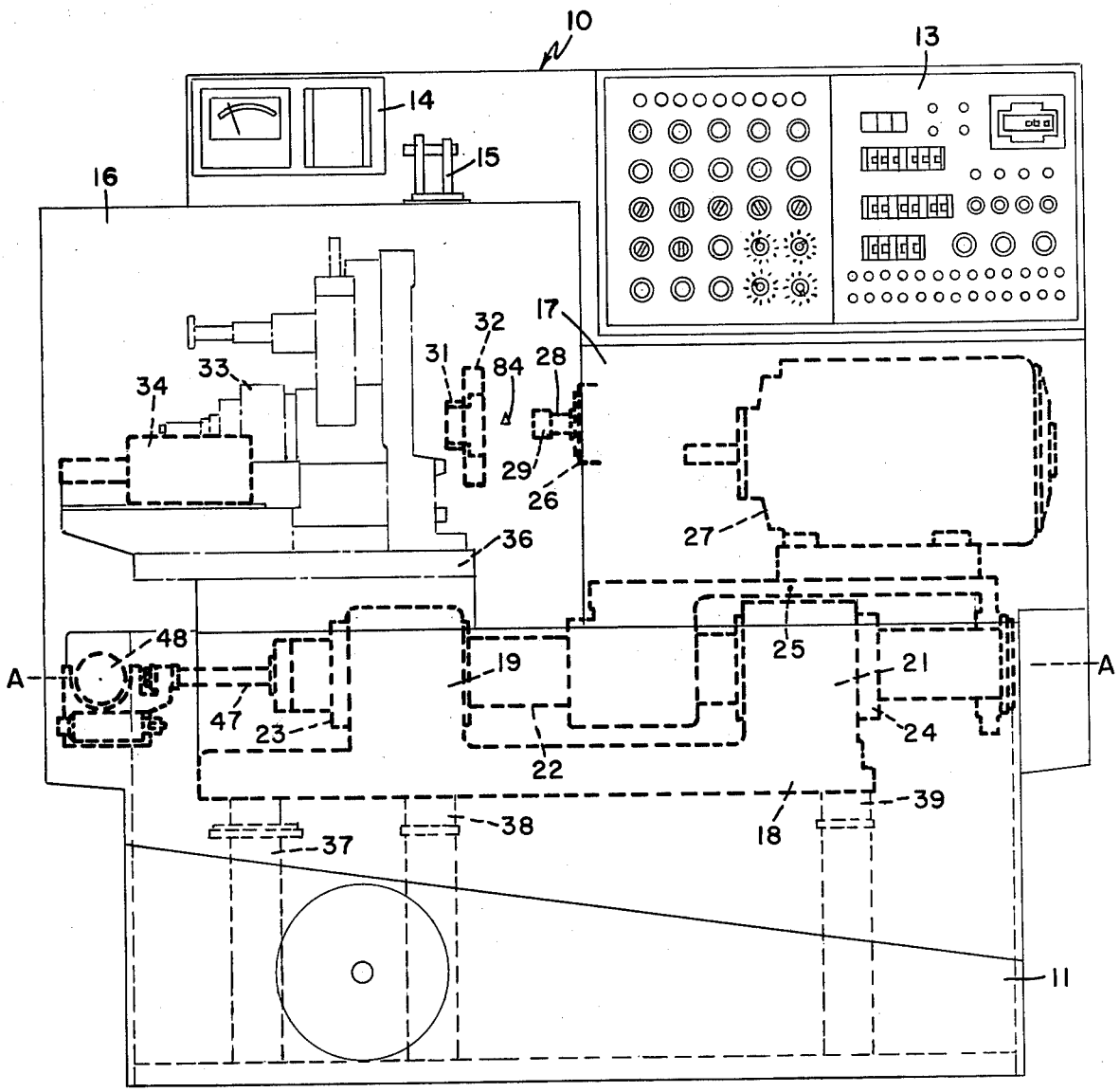
FIG. 2 is a front elevational view of the grinding machine with interior elements shown in dotted lines.

FIG. 2 shows a front elevation of the machine with some of the important elements in the interior of the housing shown in dotted lines. Located in the housing is a base 18 with a generally flat bottom from the upper part of which extend two spaced abutments 19 and 21 through which extends a cylindrical primary bar 22. The bar is carried in bearings 23 and 24 located in the abutments 19 and 21, respectively, so that the bar is capable of rotation about the axis A—A. A wheelhead table 25 is fixed to the bar 22 so as to move with it, the table being located between the abutments 19 and 21 and extending laterally of the bar. A wheelhead 26 is mounted on the table and is driven by a wheelhead motor 27 also mounted on the table. A spindle 28 is rotatably carried in the wheelhead and has an abrasive wheel 29 mounted on its outer free end.

A workpiece 31, which in the preferred embodiment is shown as consisting of the outer race of a ball bearing, is held tightly by a clamp 32 in a workhead 33. The details of the workhead and loading mechanism are shown in U.S. Pat. No. 3,546,823 of December 15, 1970. Mounted on the workhead is a gage 34 for measuring the diameter of the bore in the workpiece while it is being ground. The workhead is mounted on a workhead table 36 and the base 18 is mounted on three support posts 37, 38, and 39 and mounted in the interior of the housing 11. The posts are located at the corners of an imaginary triangle lying in a horizontal plane.

The upper part of the housing is constructed as a coolant tub from which extends the posts 37, 38, and 39 to provide a 3-point support for the base 18. A hydraulic fluid reservoir is provided in the housing (under the tub) to conserve floor space. The cast iron construction (with mounts on three points to act as vibration absorbers in the housing) provides rigid support for the bridge, oscillator, and feeding mechanisms.

An actuator 47, including a hydraulic cylinder contained within the primary bar 22, extends from the left-hand end of the bar and is attached to an oscillator 48 having an eccentric disk. This actuator serves to move the bar 22 and the table 25 longitudinally along the axis A—A.

Figure 3:
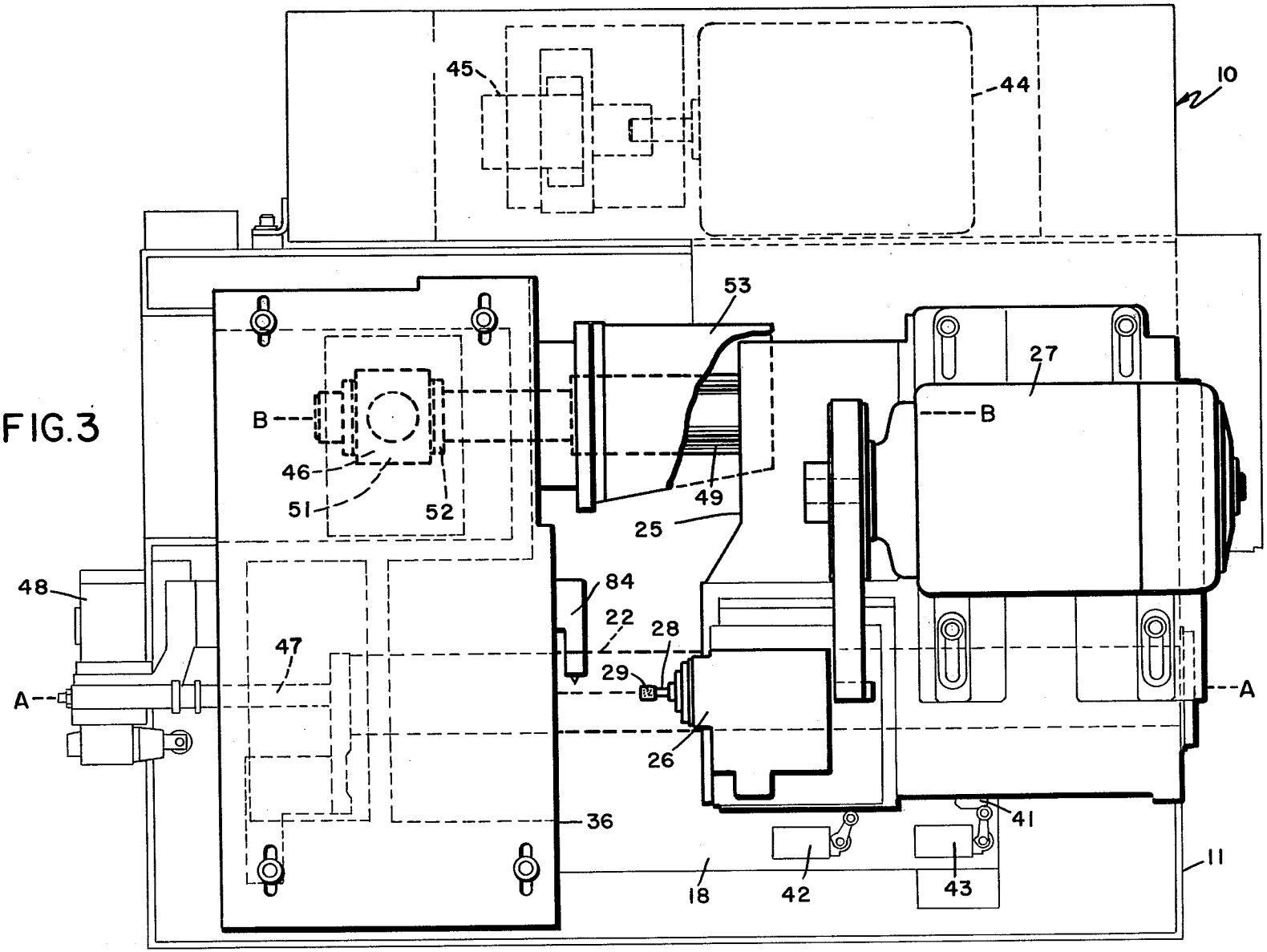
FIG. 3 is a plan view of the grinding machine with portions removed.
Figure 4:
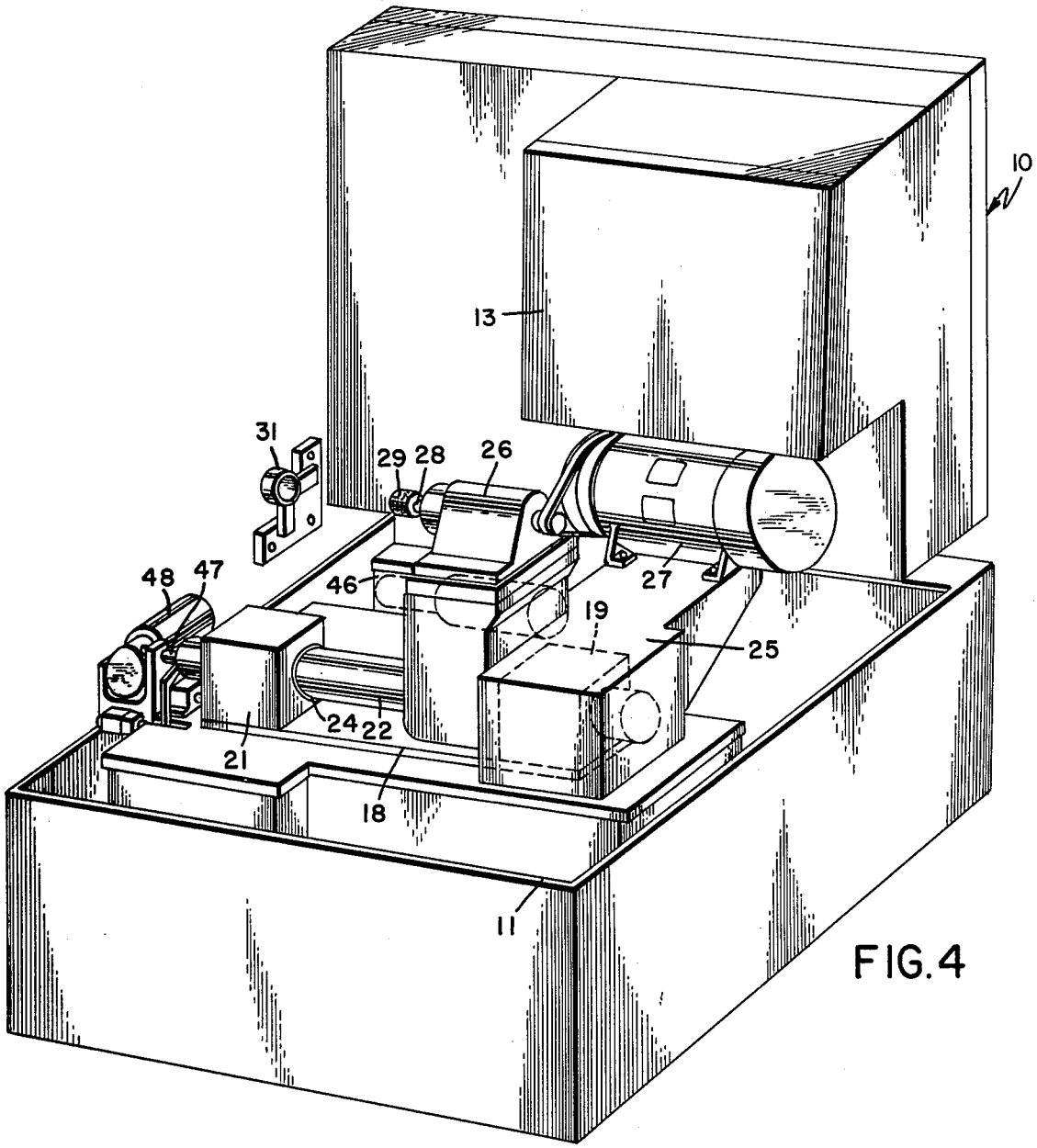
FIG. 4 is a perspective view of the grinding machine with portions removed.

Referring next to FIG. 3, which is a plan view of the machine with the covers 16 and 17 removed, it can be seen that the wheelhead table 25 that was provided with a dog 41 which engages on occasion with limits which is 42 and 43 mounted on the base 18. An oil pump 44 is located at the rear of the housing 11 and is driven by a motor 45. A feed mechanism 46 is located at the rear of the housing and extends between the base 18 and the wheelhead table 25 at a position substantially spaced from the primary bar 22. The feed means 46 serves to rotate the table 25 and the bar 22 together about the axis A—A. A secondary bar 49 is mounted in the rear part of the table 25 and extends parallel to the axis A—A to the feed mechanism 46 where it lies under the workhead bridge plate 36 at the rear thereof. A shield 53 extends over the exposed portion of the bar 49. The feed mechanism 46 includes a block 51 having a horizontal bore in which resides a bearing 52 through which the secondary bar 49 slidably passes, the axis of the secondary bar 49 being indicated by the axis B—B in FIG. 3. In this view, incidently, the workhead 33, the gage 34, and the loading mechanism 35, etc., have been removed from the bridge plate 36 for clarity of presentation.

FIG. 5 shows some of the above-described elements in perspective, but most of the workhead has been removed for clarity and only the workpiece 31 and its supporting shoes are shown. FIG. 5 shows the feed mechanism 46, including the block 51 and the bearing 52 which are moved up-and-down vertically by a stepping motor 54 operating through a ball screw 55 and nut 56, the axis of the ball screw being indicated by the axis C—C in FIG. 5. This line C—C is perpendicular to a horizontal plane passing through the axes A—A of the primary bar 22 and B—B of the secondary bar 49. FIG. 6 shows the block 51 with its bearing 52 (which is of the hydrostatic type) mounted on the secondary bar 49. The stepping motor 54 has a worm 57 connected to its shaft, which worm in turn drives a worm gear 58 (FIG. 5). The ball screw 55 engages the nut 56 in the well-known manner and serves to move the block 51 vertically carrying the secondary bar 49 with it. The block is attached to the nut by a connection 59 which is relatively narrow at a location between the nut in the bearing to permit a slight bending.

As is evident in FIGS. 5 and 6, provision is made to allow for an angular misalignment of the block 51 relative to the ball screw 55 and the nut 56. This is necessary because of the fact that, as the wheelhead table 25 swings about the axis A—A of the primary bar 22, it carries the secondary bar with it. The axis B—B of the seconary bar moves in an arc and this means that the bar and the block also move horizontally relative to the centerline or axis C—C of the ball screw. The nut 56 is formed in two parts, each part having exterior flanges. By clamping the flanges together by bolts 75, it is possible to prestress the elements of the ball screw-nut arrangement to remove blacklash from the system. In order to adjust the amount of the prestress to desired value, a shim 76 is inserted between the flanges. Extending between the flanges of the upper half of the nut 56 and the block 51 are spacers 77 and 78. A single bolt 79 extends through the flanges at one side of the nut and through the spacer 77 into the block 51; a similar bolt 81 passes through the flanges at the other side of the nut and through the spacer 78 into the block 51. The two bolts 79 and 81 are located in a vertical plane which passes through the axis C—C of the ball screw 55 and through the axis B—B of the secondary bar 49. The slight angular movement that takes place between the block 51 (on the one hand) and the nut 56 and the screw 55 (on the other hand) is permitted by the bending and stretching of the bolts 79 and 81 and their associated spacers 77 and 78, respectively. In other words, the connection 59 serves to permit a limited degree of misalignment between the block 51 and the nut 56, which is necessary because of the movement of the bar 49 in a slight arc which causes it to move horizontally forwardly and rearwardly as it is swung under the impetus of the stepping motor 54.

Figure 7:
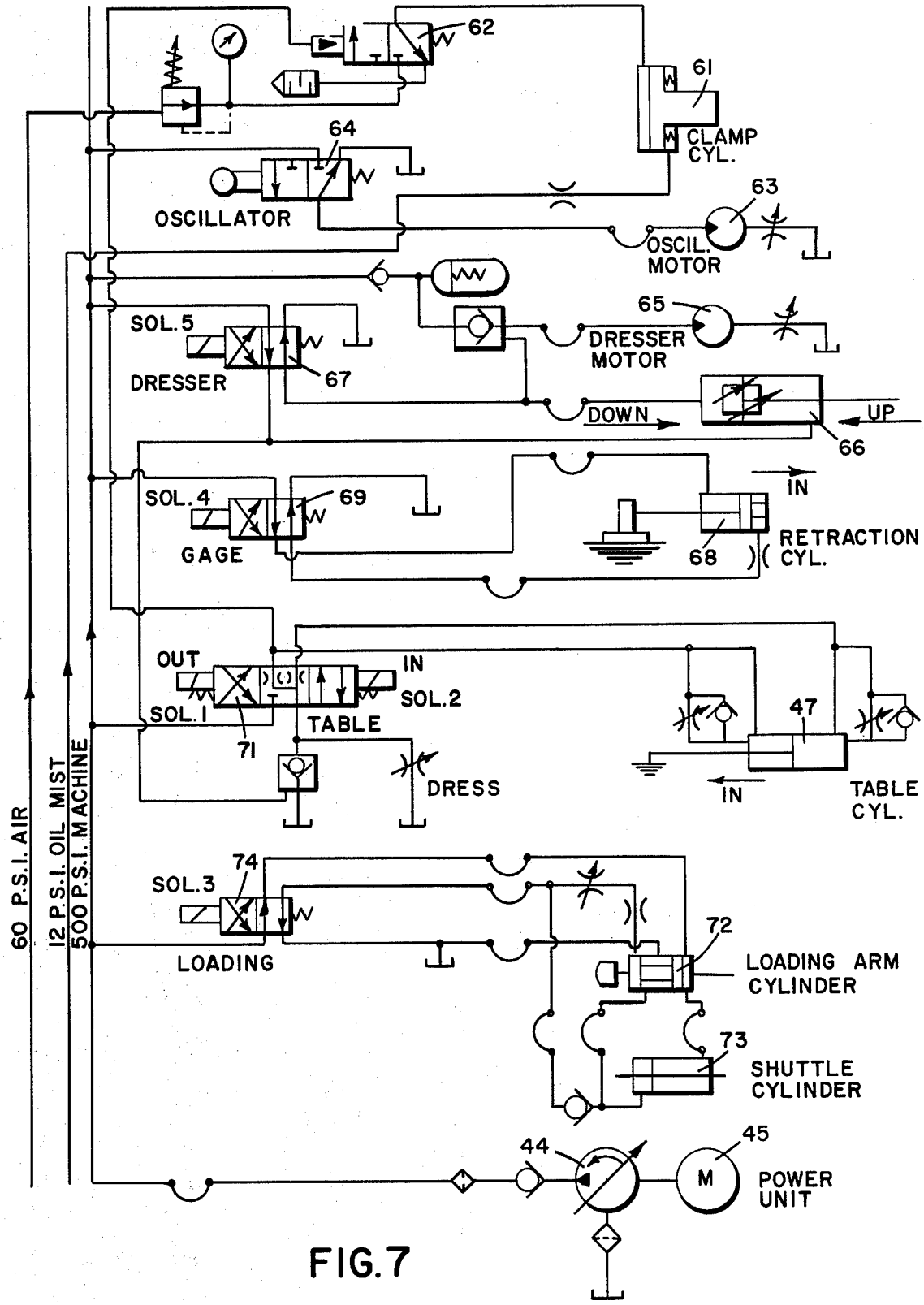
FIG. 7 is a schematic diagram of the hydraulic elements in the machine.

Referring next to FIG. 7, it can be seen that the grinding machine is provided with a number of hydraulic cylinders and with valves for controlling those cylinders in a more-or-less conventional manner. The clamping cylinder 61 operates the workpiece clamp 32 (FIG. 2) and is controlled by a solenoid valve 62. A hydraulic motor 63 operates the oscillator 48 (FIG. 2) and is controlled by a solenoid valve 64. A hydraulic motor 65 serves to operate a dresser 84 (FIG. 2) which is normally mounted on the workhead table 36. A dresser cylinder 66 serves to move the dresser up and down from operative to inoperative position; the movement of the cylinder 66, as well as the actuation of the dresser motor 65, is controlled by a solenoid valve 67. A retraction cylinder 68 serves to withdraw the gage 34 from the work on occasion and its operation is controlled by a solenoid valve 69. The table cylinder 47 is, of course, built into the primary bar 22 and serves to move that bar (along with the table 25) longitudinally of the axis A—A; the cylinder 47 is controlled by the solenoid valve 71. A loading arm cylinder 72 and a shuttle cylinder 73 operates as part of the loading mechanism 15 in a conventional manner to introduce workpieces into the work area and remove them. These last two cylinders are controlled by the solenoid valve 74. The pump 44 driven by motor 45 is shown as supplying the hydraulic system with pressure fluid for most of the cylinders. A separate air source is connected to the clamping cylinder 61 for unclamping the workpiece and a low pressure source of oil mist is also connected to that cylinder for lubrication purposes.

The operation of the invention will now be readily understood in view of the above description. The grinding machine is set in motion in the usual way with the motor 27 energized to drive the wheelhead 26 and to rotate the spindle 28 with its wheel 29. The workpiece 31 is rotated about the axis of the surface of revolution which is to be finished by the workhead 33 and the wheel is introduced longitudinally (along the axis A—A) into the bore in the workpiece by the actuator 47. Once in the bore, the wheel is moved laterally (rearwardly of the machine) to grind the surface of revolution that is to be finished. This lateral movement (or "feed") is brought about by the operation of the feed mechanism 46 which acts to rock the wheelhead and the primary bar about the axis A—A. The control 13 transmits pulses to the stepping motor 54 to cause it to rotate incrementally in one direction or the other and the stepping motor operates through the worm 57 and the gear 58 to rotate the ball screw 55. This causes the centerline of the abrasive wheel 29 to move through an arc, during a portion of which arc the wheel removes stock from the workpiece 31 to finish a surface of revolution thereon.

Figure 8:
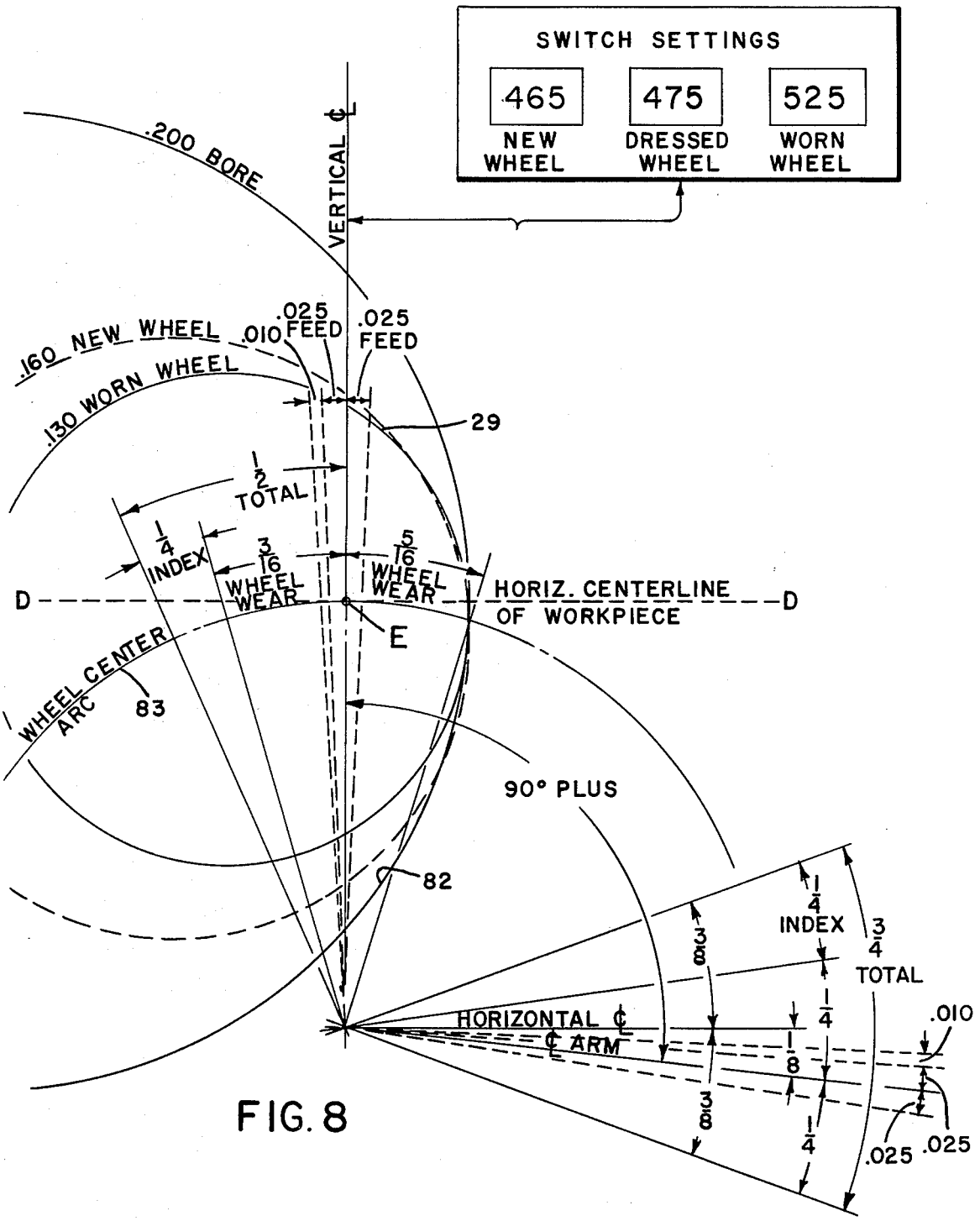
FIG. 8 is a diagram showing the paths of movement of important portions of the machine.

FIG. 8 shows the geometric relationship between the wheel and the workpiece during the grinding operation. The horizontal line D—D passes through the centerline of the workpiece. The surface of revolution of the workpiece to be finished is indicated by the reference numeral 82 and the abrasive wheel 29 is shown in contact with it. The wheel 29 in solid lines represents the location of a small "worn" wheel and the one in dotted lines indicates a large "new" wheel. Also shown in the drawing is the arc 83 along which the centerline of the wheel passes as feed takes place under the impetus of the stepping motor 54. The arc 83 is tangential to and lies on the underside of the horizontal center line of the workpiece D—D. Furthermore, the feeding arrangement at the end of the arm or table 25 is selected so that approximately one-half (0.025 inch) of the feeding operation takes place before the tangent point E is reached and the other half (0.025 inch) of the motion takes place after passing through that tangent point. The effect of the centerline of the wheel always remaining under the line D—D is to assure that the workpiece is not presented with grinding forces which tend to lift it out of its support shoes. In the preferred embodiment, the axis of the spindle 28 and of the abrasive wheel 29 is adjusted to lie exactly over the top of the axis A—A of the primary bar 22. It can be seen, then, that the arc of movement from initial grinding of the surface to finish grinding is substantially equally spaced on either side of a vertical plane passing through the axis A—A of the bar 22. It can also be seen that the arc swept by the axis of the abrasive wheel is tangential to a horizontal plane extending through the axis of the surface of revolution of the workpiece 31.

By selecting the position of the wheel center slightly rearwardly in relation to the centerline of the bar, we are able to obtain the optimum condition for maintaining the wheel center and the work center on the same horizontal centerline. If this is not accomplished, there arise (1) some problems in going below the centerline, particularly where the final size position is determined by switches (Sizematic), and (2) if the workpiece surface to be finished is tapered, the ground surface becomes a conic section, which is undesirable, instead of having the desired straight line generatrices.

Figure 9:
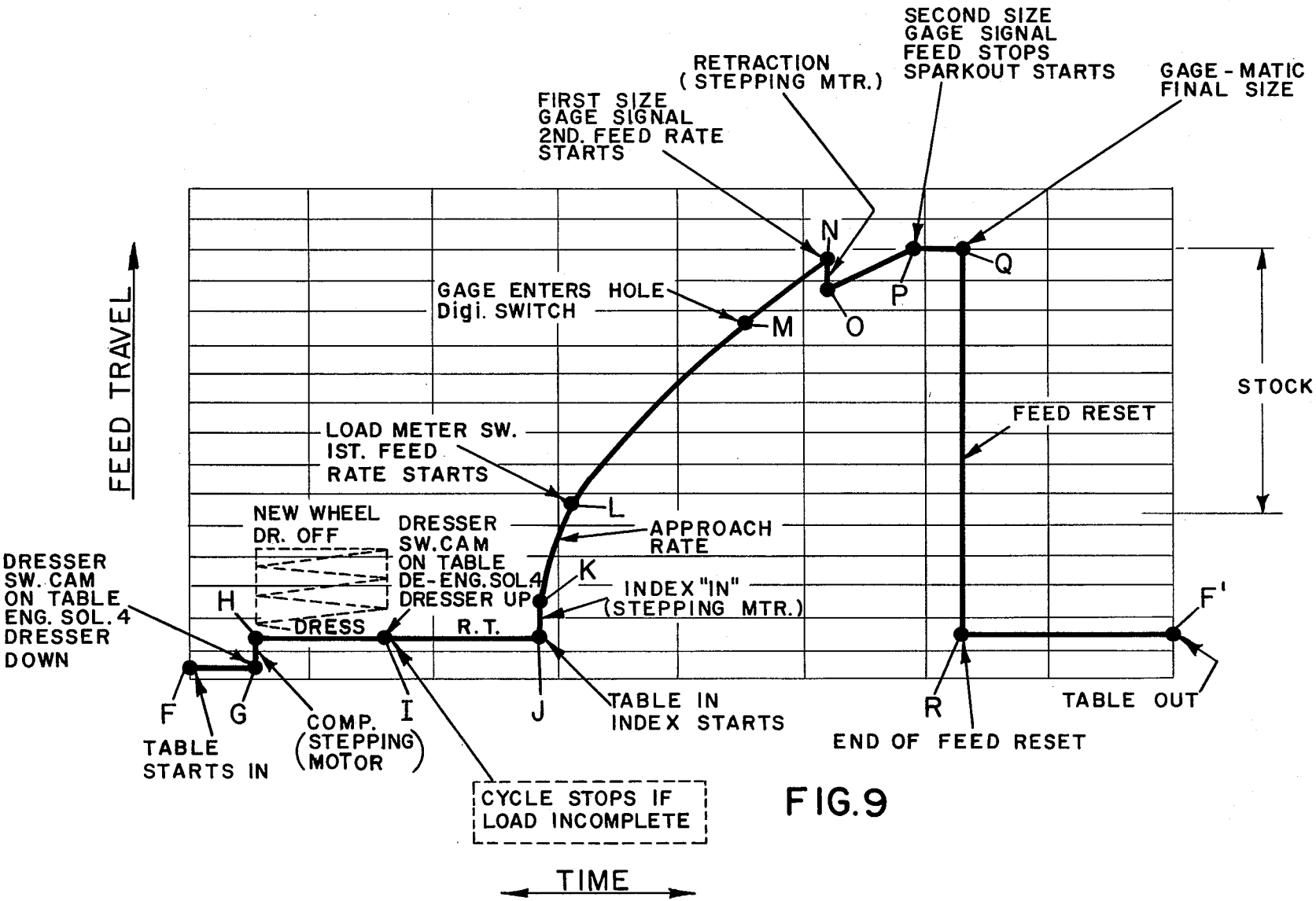
FIG. 9 is a diagram of a typical grinding cycle performed by the machine.

FIG. 9 shows a typical grinding cycle making use of the present invention. The machine starts its grinding cycle with the wheel 29 located outside of the bore of the workpiece and substantially spaced from the dresser 84 (see FIGS. 2 and 3) and this is indicated on the diagram as the point F. The bar 22 carrying the wheelhead table 25 and the wheelhead 26 is moved by the actuator 47 longitudinally parallel to the axis A—A into the vicinity of the dresser 84, so that the wheel arrives at the point G just ahead of the dresser. At that point, the dresser is brought into its down (operative) position and the wheel is moved laterally by a compensation increment to the point H. The wheel is then moved longitudinally again to perform a dressing operation which is finished at the point I. The table and wheel continue inwardly on a rapid traverse to the point J. These longitudinal motions take place by introducing hydraulic fluid into the cylinder of the actuator 47. The table feeds in upon receipt of pulses from the control 13 by the stepping motor 54 and arrives at the point K. The wheel approaches the surface of the workpiece to the point L. Grinding takes place to the point M where the gage 34 enters the bore. The grinding continues to the point N at which time the gage indicates that first size has been reached. The wheel is then backed off to the point O and grinding takes place again at a second slower feed rate until the gage indicates that the second size has been reached at the point P. Feed then stops and spark-out takes place until the final size is reached, as indicated by the gage, at the point Q. At that point the wheel is retracted to the point R, the actuator 47 moves the table out to the point F', and the cycle is completed. The oscillator 48, of course, operates during the grinding operation to move the wheel longitudinally by slight amounts to improve the grinding quality in the well-known manner.

The advantages of the present invention will now be readily understood in view of the above description. It is obvious that the present invention provides a grinding machine with a simple and rugged construction which is capable of a high degree of accuracy. The grinding stresses are restricted to a few simple elements which are involved in the actual grinding operation and the remainder of the machine can be constructed in a relative light, inexpensive nature. Furthermore, only a small portion of the grinding stresses are transmitted to the main guide surfaces, so that no inaccuracies are introduced into the workpiece surface because of the nature of those surfaces. The machine has a low vertical profile and, in general, has a relatively small volume as compared with conventional grinding machines of like capacity. All cross-feed motions take place under digital control and without the inaccuracies introduced by analog control. The machine is simple in construction, can be inexpensively manufactured, and is capable of a long life of useful service with a minimum of maintenance. Particularly, the use of a cylindrical bar as the major element provides increased bearing surface without increasing the overall size of the machine. It can be seen that the use of two cylindrical bars as the principle guide elements remove the inaccuracies introduced by deflection of other types of support surfaces.

The present invention in which the primary bar 22 and the table 25 slide together through bearings in the abutments 19 and 21 present a number of advantages. For one thing, it gives a longer bearing "spread," as compared with situations where the table slides over a fixed bar. It is possible (because the bearings are in fixed positions and do not move) to sue hydrostatic bearings with all of the attendant advantages thereof, including freedom from friction and high damping of vibrations. In the grinding position, the bar 22 has a short cantilever beam length. Because of the high stiffness of the construction, there is less problem with chatter. Furthermore, the fact that a fixed feeding mechanism operates on a slidable bar 49 at the other side of the table means that a short cantilever is provided to which the feeding forces are directed. This means that there is less deflection in the feeding apparatus because the high stiffness tends to prevent it. The use of a ball screw provides for accuracy of feed and compensation, particularly when all backlash has been removed in the manner described above and when the angular deflection is possible between the fixed or stationary feed unit and the block 51.

The simplified design of the actuator 47 and the oscillator 48 causes the oscillation forces to be brought directly to bear on the centerline of the bar 22, so that there are no lateral forces involved. Furthermore, the combining of the hydraulic cylinder (forming part of the actuator 47) with the operation of the oscillator leads to a less expensive construction. The three-point mounting of the base 18 on the support posts 37, 38, and 39 (which lie in a triangle) leads to a strong and simplified construction.

A commercial machine version of the invention designed to grind internal bores in workpieces having a maximum outside diameter of 3 3/16 inches, having a minimum outside diameter of ⅜ inch, having a maximum length of work of 1 inch, having a minimum length of 3/16 inch, and having a minimum internal bore diameter of ¼ inch, was constructed to produce a maximum table travel of 6 inches and a maximum length of oscillation provided by the oscillator 48 of ¼ inch. The housing 11 was constructed of welded steel with actual dimensions on the floor of 51½ inches × 36 inches. As has been described above, there was a 3-point support for the cast iron base 18. A hydraulic fluid resevoir was provided in the housing to conserve floor space and the upper part of the housing 11 was shaped as a coolant tub. The workhead motor selected was one-half horsepower operating at 3600 RPM. The distance from the centerline of the wheel to the floor was but 38 inches and the overall height of the machine only 57 inches. This demonstrates the compact machine size relative to the range of work size to be handled by the commercial machine.

It is obvious that minor changes may be made in the form and construction of the invention without departing from the material spirit thereof. It is not, however, desired to confine the invention to the exact form herein shown and described, but it is desired to include all such as properly come with the scope claimed.

The invention having been thus described, what is claimed as new and desired to secure by Letters Patent is:

1. Internal grinding machine, comprising:

(a) a base having two spaced abutments, (b) a primary bar extending between the abutments and mounted therein in hydrostatic bearings for rotation of the bar about an axis extending longitudinally of the bar and for movement of the bar in the direction of the axis, (c) a wheelhead table fixedly fastened to the bar between the abutments and extending laterally thereof, said table including a wheelhead having a rotatable spindle on the end of which is carried an abrasive wheel, (d) feed means located at a position substantially spaced from the primary bar for rotating the table and the bar together about the said axis, and (e) an actuator operating on one end of the bar to move the bar and the table longitudinally along the axis, said actuator including a fluid cylinder providing the major longitudinal movements to the bar for bringing the grinding wheel toward and away from a workpiece and a mechanical actuator for oscillating the grinding wheel when it is in contact with the workpiece.

2. Internal grinding machine as recited in claim 1, wherein a secondary bar is mounted on the table with its axis extending parallel to and spaced from the axis of the primary bar, wherein the feed means includes a block carrying a bearing through which the secondary bar is slidable.

3. Internal grinding machine as recited in claim 2, wherein the feed means includes a stepping motor driving a ball screw operating in a line perpendicular to a plane passing through both axes.

4. Internal grinding machine as recited in claim 2, wherein the ball screw includes a nut, and wherein the said block is attached to the nut by a connection which is relatively narrow in said plane with respect to its dimension in a transverse plane at a location between the nut and the block to permit angular deflection of said connection.

5. Internal grinding machine as recited in claim 1, wherein a workhead is mounted on the base for supporting a workpieces having a surface of revolution to be finished, and means is provided for rotating the primary bar and the workhead to cause the abrasive wheel to move through an arc during a portion of which the wheel is removing stock from the workpiece at the said surface of revolution.

6. Internal grinding machine as recited in claim 5, wherein the arc of movement from initial grinding of the surface to finish grinding is substantially equally spaced on either side of a vertical plane passing through the said axis of the bar.

7. Internal grinding machine as recited in claim 6, wherein the arc swept by the axis of the abrasive wheel is tangential to a horizontal plane extending through the axis of said surface of revolution.

8. Internal grinding machine as recited in claim 6, wherein the said means for rotating the primary bar to cause the abrasive wheel to move through an arc is a feed means located at a position substantially spaced from the primary bar, the feed means including a stepping motor which is actuated by electrical pulses.

9. Internal grinding machine as recited in claim 8, wherein said feed means includes control means for providing pulses to the stepping motor to produce movement through the arc on a grinding cycle, including a ROUGH GRIND, a FINISH GRIND, a RETRACTION, and a COMPENSATION.

* * * * *